United States Patent [19]

Morrow et al.

[11] 3,958,511

[45] May 25, 1976

[54] SETBACK LOCK APPARATUS

[75] Inventors: Warren P. Morrow, Silver Spring, Md.; Billy M. Horton, Washington, D.C.

[73] Assignee: The United States of America as represented by the Secretary of the Army, Washington, D.C.

[22] Filed: June 11, 1974

[21] Appl. No.: 478,203

[52] U.S. Cl. ..... 102/78; 102/73 R

[51] Int. Cl.[2] ..... F42C 15/29

[58] Field of Search ..... 102/78, 80, 75, 76 R, 102/76 P, 79, 81, 73

[56] References Cited

UNITED STATES PATENTS

| | | | |
|---|---|---|---|
| 2,625,881 | 1/1953 | Rabinow | 102/78 |
| 2,712,284 | 7/1955 | Thomas et al. | 102/78 |
| 2,977,882 | 4/1961 | Jasse | 102/78 |

*Primary Examiner*—Harold Tudor

*Attorney, Agent, or Firm*—Nathan Edelberg; Robert P. Gibson; Saul Elbaum

[57] ABSTRACT

A setback lock apparatus is provided for use with an ordnance missile fuze. The lock includes a body having a planar top surface and a cavity extending in a generally downward direction into the body. The cavity has an opening at its top and is symmetrical about a linear axis perpendicular to the top planar surface. A first spring mass system comprising a coil spring and a steel ball atop the coil spring is situated within the cavity and centered about the linear axis. A second spring mass system comprising a second coil spring and a plurality of second steel balls atop the second coil spring is also situated within the cavity surrounding the first spring mass system. The spring mass systems are designed so that at low acceleration forces the first steel ball protrudes through the top planar surface and prevents alignment of the fuze, at high accelerational forces the second steel balls compress the second coil spring and move downward into a widened portion of the cavity, thus permitting the first steel ball to move downward compressing the first coil spring and to pass between them. As accelerational forces decrease, the first steel ball will be trapped in the bottom of the cavity, thus releasing the lock apparatus and permitting the alignment of the missile fuze.

6 Claims, 8 Drawing Figures

SETBACK LOCK APPARATUS

RIGHTS OF THE GOVERNMENT

The invention described herein may be manufactured, used, and licensed by or for the United States Government or for governmental purposes without the payment to us of any royalty thereon.

BACKGROUND OF THE INVENTION

The present invention relates generally to a safety setback lock or release for ordnance devices and more particularly to a device for arming the fuze of an ordnance missile only after a predetermined period of sustained acceleration such as occurs, for example, in the discharge of a rocket.

In ordnance missiles, which commonly carry explosive charges, it is desirable that the missiles remain safe or "unarmed" until they have been fired. This unarmed state insures maximum safety of the personnel using the missile and enables the explosive to cause damage to the target. Various means have been used to secure this result. For example, rotating missiles have been equipped with arming mechanisms which are responsive to the centrifugal forces developed when the missile is fired. Non-rotating missiles, such as mortar shells, certain classes of rockets and the like, have been equipped with arming mechanisms which are responsive to the forces of setback, which occurs when the missile is launched. However, in U.S. Pat. No. 2,625,881, there is shown such an arming mechanism which includes a particular double element release which is responsive to sustained acceleration only. The double element release mechanism includes a pair of spring mass systems wherein the masses are a pair of concentric sliding cylinders.

SUMMARY OF THE INVENTION

A setback lock apparatus is provided for use with an ordnance missile fuze. The lock body has a planar top surface and a cavity extending in a generally downward direction into the body. The cavity is symmetrical about a linear axis perpendicular to the top planar surface and has an opening at its top defined by the intersection of the cavity and the planar top surface. A first coil spring is situated within the cavity and is centered about the linear axis. A first mass element is also situated in the cavity in contact with the first coil spring and is operative in a rest position to protrude through the opening at the top of the cavity and under accelerational forces to move downward into the cavity and compress the first coil spring. A second coil spring which is larger than the first coil spring is situated within the cavity and is centered about the linear axis so as to surround the first coil spring. A plurality of second mass elements are situated in the cavity in contact with the second coil spring and are operative under low accelerational forces to block the movement of the first mass element within the cavity and under high accelerational forces to move downward into the cavity, compress the second coil spring, and permit downward movement of the first mass element.

OBJECTS OF THE INVENTION

It is an object of the present invention to provide an improved setback lock apparatus.

Another object of the present invention is the provision of a setback lock apparatus which is simple in construction and therefore easy to manufacture.

A further object of the present invention is the provision of a setback lock apparatus which is both reliable and inexpensive to manufacture.

Other objects, advantages and novel features of the present invention will become apparent from the following detailed description of the invention when considered in conjunction with the accompanying drawings.

DESCRIPTION OF THE PREFERRED EMBODIMENT

Figure 1:
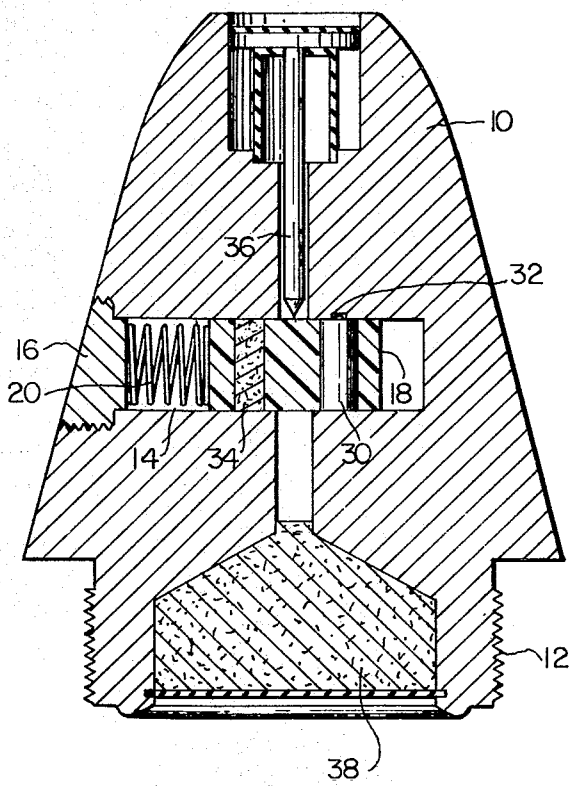
FIG. 1 is a longitudinal section of a projectile detonator for a fuze nose housing the setback lock apparatus of the present invention.

Referring to FIG. 1, an example is shown of the environment in which the safety setback lock apparatus of the present invention may be used. A fuze 10 is adapted to be screwed into the nose of a projectile (not shown) by means of threads 12. The fuze 10 contains a transverse bore 14 which is closed by threaded block 16. The transverse bore 14 contains a slidable plastic element 18, which may be suitably keyed to prevent rotation in the bore 14. The slidable plastic element 18 is shown as being biased to the right by spring 20 and is restrained against displacement by the safety setback lock of the present invention, generally indicated at 30. Part of the safety setback lock 30 projects into a recess 32 in bore 14 to thereby prevent movement of slidable plastic elements 18. It is apparent that if the projection on the setback lock 30 is withdrawn into the lock mechanism, the slidable plastic element 18 will move to the right until a detonator 34 is aligned with a firing pin 36 to thereby arm the fuze 10 in a known fashion. Upon impact, the detonator 34 will be fired by the pin 36 which will in turn set off a booster 38 to explode the projectile charge. It should be understood, of course, that in place of the impact mechanism shown, any other type of fuze mechanism may be employed. The present invention is concerned primarily with the setback lock apparatus 30 which will now be described in more detail with reference to FIGS. 2–8.

Figure 2:
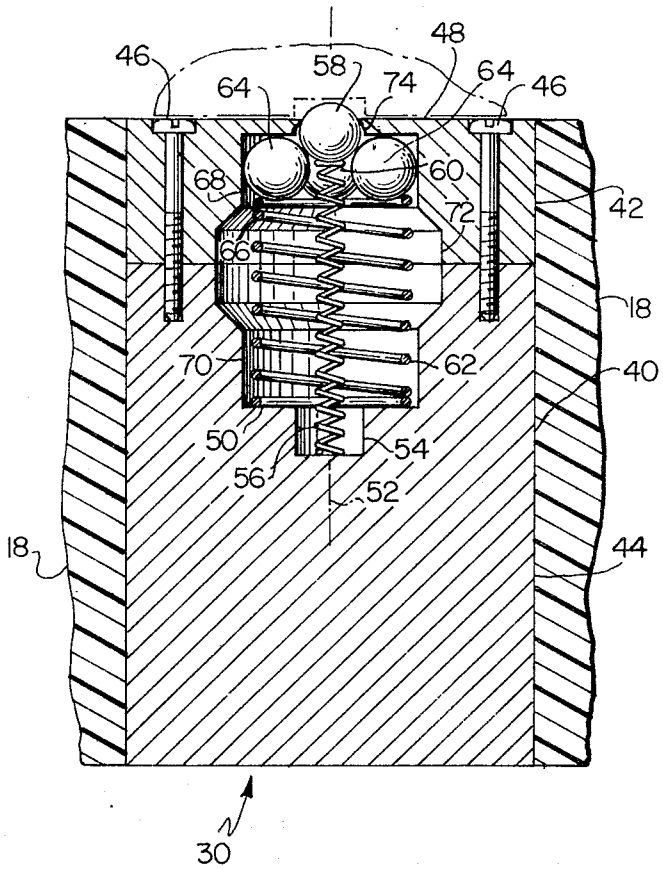
FIG. 2 is a longitudinal section to a greatly enlarged scale of the setback safety lock shown in FIG. 1 in its iniital or "safe" condition.

FIG. 2 shows a greatly enlarged longitudinal section of the setback safety lock apparatus of the present invention. The setback lock apparatus generally shown at 30 includes a body 40 having upper and lower portions 42 and 44, respectively. The upper and lower body portions 42 and 44 are preferably constructed of a cast metal and are securely joined preferably by bolts 46. The lock body 40 can be of any shape that can be easily retained within the slidable plastic element 18 but for purposes of illustration, the body is shown as a right circular cylinder. The lock body has a planar top surface 48 and a cavity 50 extending in a generally downward direction into the lock body. The cavity 50 is symmetrical about a linear axis 52 perpendicular to the top planar surface 48. The bottom of the cavity 50 includes a recess portion 54 into which is inserted a first coil spring 56, also centered about the linear axis 52. Also situated within cavity 50 is a first mass element, preferably a steel ball 58, which is in contact with the top portion 60 of coil spring 56 and, together with coil spring 56, forms a first spring mass system. The cavity 50 houses a second coil spring 62 which is larger in diameter than the first coil spring 56 and is also centered around the linear axis 52 so as to surround the spring 56. A plurality of second mass elements, preferably steel balls 64, are contained within the cavity 50 and maintained in contact with the top portion 66 of the second coil spring 62. The steel balls 64 are preferably slightly larger in diameter than the steel ball 58, although a wide range of sizes would be operative. The cavity 50 is generally in the shape of a right circular cylinder wherein the upper and lower wall portions 68 and 70, respectively, have a diameter which is slightly larger than the sum of the diameters of two steel balls 64 plus the diameter of the first coil spring 56, and which is less than the sum of the diameters of two steel balls 64 plus the diameter of the steel ball 58. The cavity 50 further includes a central portion 72 having a diameter which is larger than the diameter of the upper and lower portion 68 and 70, which diameter is larger than the sum of the diameters of two steel balls 64 plus the diameter of steel ball 58. The cavity 50 includes an opening at its top defined by the intersection of the cavity with the planar top surface 48 and including a lip portion 74 for retaining the steel ball 58 within the cavity 50.

Figure 3:
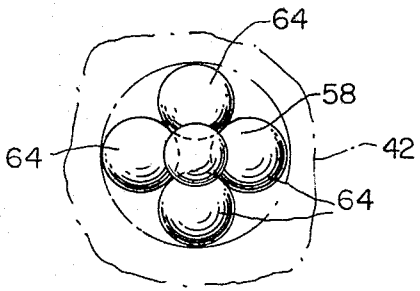
FIG. 3 is a top partial cutaway view of the setback safety lock as shown in FIG. 2.

FIG. 3 shows a top view of the lock 30 with the lock body shown in phantom to reveal the initial positions of the ball 58 and the balls 64. While four balls 64 are illustrated, it should be noted that the number of balls 64 may vary from 3 or more, with four or five having been found to yield optimal results.

Figure 4:
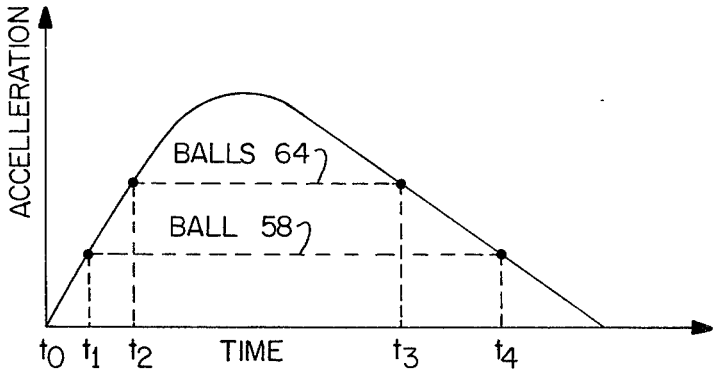
FIG. 4 is a graph of acceleration versus time for the projectile carrying the setback lock of the present invention.

FIG. 4 shows a graph of acceleration versus time for the projectile in which the setback safety lock apparatus of the present invention is held. The action for the setback lock 30 will now be described in connection with FIGS. 2–8. FIG. 2 shows the position of the lock at time $t_0$ at which the lock is subjected to only gravitational forces. Thus the force of the spring 56 on the ball 58 is sufficient to keep it protruding beyond the planar top surface 48 to thereby prevent the lock 30 from sliding within the bore 14.

Figure 5:
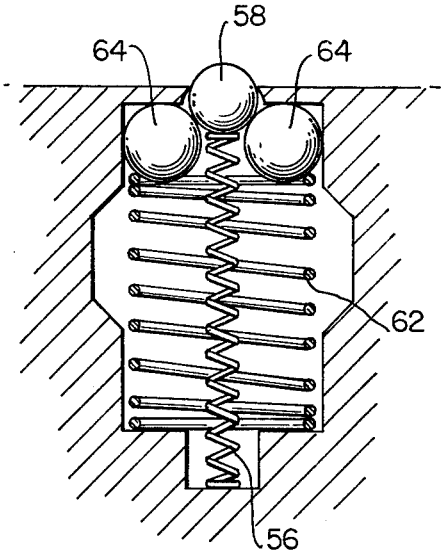
FIGS. 5, 6, 7 and 8 are schematic showings of the action of the setback lock apparatus of the present invention.

FIG. 5 shows the position of the lock 30 at time $_1$, accelerational forces having been built up to the point where the accelerational force on the ball 58 begins to overcome the force applied by spring 56 and the ball 58 attempts to travel downward within cavity 50. However, since ball 58 cannot pass between balls 64, the ball 58 is maintained in position protruding beyond the planar top surface 48 to thereby prevent the lock 30 from sliding within the bore 14.

Figure 6:
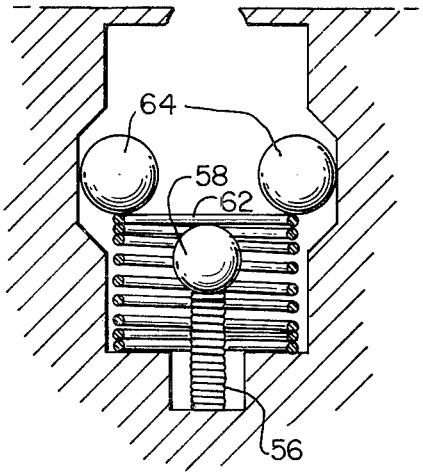

FIG. 6 schematically depicts the position of lock 30 at time $t_2$ when the accelerational forces on the balls 64 overcome the force applied to the balls 64 by the spring 62 and the balls 64 move in a downward direction compressing the springs 62 until the balls 64 reach the widened central portion 72 of the cavity 50. The steel ball 58 is now free to move in a downward direction and pass between the balls 64, thus freeing the lock 30 for movement in a lateral direction with the bore 14.

Figure 7:
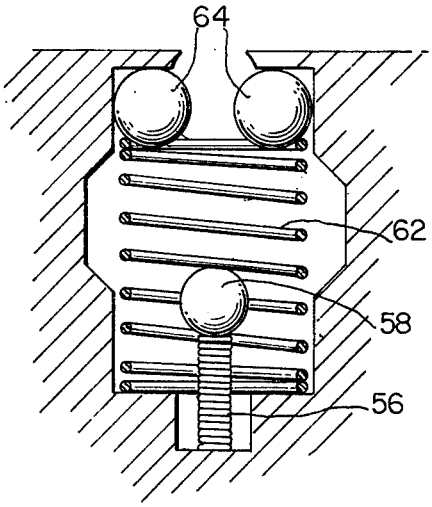
Figure 8:
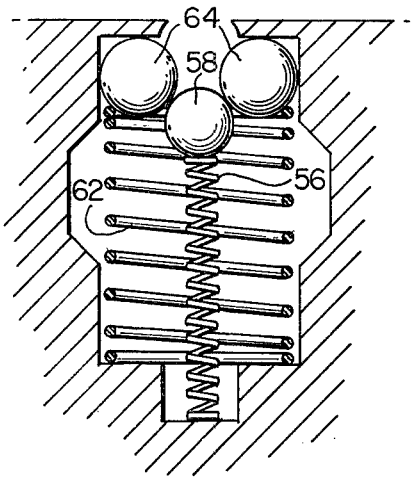

FIG. 7 shows the position of the lock 30 at time $t_3$ when the accelerational forces have decreased to the point where the force applied to the balls 64 by the spring 62 forces the balls in an upward direction within the cavity 50 to their original position. FIG. 8 shows the position of the lock 30 at time $t_4$ when the accelerational forces have further decreased to the point where the force applied to the ball 58 by the spring 56 forces it in an upward position within the cavity 50. However, since the ball 58 cannot pass between the balls 64 within the cavity 50, the ball 58 is forever trapped within the bottom of the cavity 50, thereby permitting the spring 20 to align the detonator 34 with the firing pin 36 within the fuze 10.

Thus, it is apparent that the setback lock apparatus of the present invention is quite efficient in operation, while at the same time being very simple and inexpensive in construction. Steel balls and coil springs are exceptionally low in cost and are available in standard sizes, thus allowing a great deal of flexibility in the design of a particular system.

We wish it to be understood that we do not desire to be limited to the exact details of construction shown and described, for obvious modifications can be made by a person skilled in the art.

What is claimed:

1. A setback lock apparatus for use with an ordnance missile fuze comprising:

a. a body having a planar top surface and a cavity extending in a generally downward direction into said body, said cavity having an opening at its top defined by the intersection of said cavity and said top planar surface and said cavity further being symmetrical about a linear axis perpendicular to said top planar surface;

b. a first coil spring situated within said cavity, said first coil spring being centered about said linear axis;

c. a first mass element situated in said cavity and in contact with said first coil spring, said first mass element being operative in a rest position to protrude through the opening at the top of said cavity and operative under accelerational forces to move downward into said cavity and compress said first coil spring;

d. a second coil spring situated within said cavity, said second coil spring being larger in diameter than said first coil spring and being centered about said linear axis so as to surround said first coil spring; and e. a plurality of second mass elements situated in said cavity and in contact with and situated between said first mass element and said second coil spring; said second mass elements being operative under low accelerational forces to block the movement of said first mass element within said cavity and being operative under high accelerational forces to move downward into said cavity, compress said second coil spring and permit the downward movement of said first mass element which compresses said first coil spring.

2. A setback lock apparatus as set forth in claim 1 wherein said first mass element and said second mass elements are spherical, said second mass elements being slightly larger in diameter than said first mass element.

3. A setback lock apparatus as set forth in claim 2 wherein said first mass element and said second mass elements are steel balls.

4. A setback lock apparatus as set forth in claim 2 wherein said cavity is generally cylindrical, said cavity having upper and lower portions having a diameter which is slightly larger than the sum of the diameters of two of said second mass elements plus the diameter of said first coil spring, said cavity further having a central portion having a diameter which is larger than the diameter of said upper and lower portions, said central portion serving to cooperate with said first and second mass elements under high accelerational forces by permitting said second mass elements to be pushed aside by the downward motion of said first mass element so that said first mass element may pass between said second mass elements.

5. A setback lock apparatus as set forth in claim 1 wherein the opening at the top of said cavity includes a lip portion for retaining said first mass element within said cavity.

6. A setback lock apparatus as in claim 1 wherein the opening at the top of said cavity is smaller than the diameter of one of said second mass elements.

* * * * *